US011345012B2

(12) United States Patent
Chen et al.

(10) Patent No.: US 11,345,012 B2
(45) Date of Patent: May 31, 2022

(54) RATCHET WRENCH

(71) Applicants: Yung-Shun Chen, Taichung (TW); Cheng-Chou Wu, Taichung (TW)

(72) Inventors: Yung-Shun Chen, Taichung (TW); Cheng-Chou Wu, Taichung (TW)

( * ) Notice: Subject to any disclaimer, the term of this patent is extended or adjusted under 35 U.S.C. 154(b) by 259 days.

(21) Appl. No.: 16/695,908

(22) Filed: Nov. 26, 2019

(65) Prior Publication Data

US 2021/0154823 A1 May 27, 2021

(51) Int. Cl.
*B25G 1/08* (2006.01)
*B25B 13/46* (2006.01)

(52) U.S. Cl.
CPC ..... *B25G 1/085* (2013.01); *B25B 13/46* (2013.01)

(58) Field of Classification Search
CPC ..... B25G 1/085; B25B 23/0035; B25B 13/46; B25B 13/461; B25B 13/463
See application file for complete search history.

(56) References Cited

U.S. PATENT DOCUMENTS 4,302,990 A * 12/1981 Chrichton ..... B25G 1/085 206/378
4,627,315 A * 12/1986 Lin ..... B25G 1/085 81/177.4
6,431,034 B1 * 8/2002 Chen ..... B25B 13/461 81/124.4
6,571,669 B2 * 6/2003 Benatz ..... B25G 1/085 206/350
6,634,262 B2 * 10/2003 Malchus ..... B25B 15/04 81/177.4
6,684,738 B2 * 2/2004 Huang ..... B25B 13/461 81/177.4
6,808,067 B2 * 10/2004 Benatz ..... B25G 1/085 206/350
9,782,886 B2 * 10/2017 Chuang ..... B25G 1/063
9,981,373 B2 * 5/2018 Chen ..... B25G 1/085
10,016,888 B2 * 7/2018 Liu ..... B25G 1/085
2008/0083304 A1 * 4/2008 Finn ..... B25B 15/001 81/177.4
2008/0295657 A1 * 12/2008 Cluthe ..... B25G 1/085 81/490
2021/0245354 A1 * 8/2021 Hsiao ..... B25B 23/0035

* cited by examiner

*Primary Examiner* — David B. Thomas
(74) *Attorney, Agent, or Firm* — Muncy, Geissler, Olds & Lowe, P.C.

(57) ABSTRACT

A ratchet wrench is provided, including: a main body and a handling assembly. The main body includes a head portion being assembled with a ratchet head and a handling portion remote from the head portion. The handling assembly includes a casing coveringly disposed on the handling portion, and the casing defines a receiving space which is configured to receive at least one object and has at least one opening disposed therethrough. Part of an outer surface of the handling portion is flush with or protrusive beyond the at least one opening, and a material of the handling portion is different from a material of the casing.

9 Claims, 8 Drawing Sheets

RATCHET WRENCH

BACKGROUND OF THE INVENTION

Field of the Invention

The present invention relates to a ratchet wrench.

Description of the Prior Art

A conventional ratchet wrench and its driving head (bit) are detachably assembled with each other so that the ratchet wrench can be applied to various fasteners by replacing one of a plurality of driving heads with different sizes. However, the plurality of driving heads have to be stored in a tool box, which is inconvenient to carry and easy to be omitted. Furthermore, a handle of the conventional ratchet wrench is made of plastic or rubber by injection molding, and force exerted by an operator has to be transmitted through the handle to the driving head so that the conventional ratchet wrench has poor force transmission effect and the handle is unchangeable and has low variability in appearance.

The present invention is, therefore, arisen to obviate or at least mitigate the above-mentioned disadvantages.

SUMMARY OF THE INVENTION

The main object of the present invention is to provide a ratchet wrench which can receive objects and has good force transmission effect.

To achieve the above and other objects, the present invention provides a ratchet wrench, including: a main body and a handling assembly. The main body includes a head portion being assembled with a ratchet head and a handling portion remote from the head portion. The handling assembly includes a casing coveringly disposed on the handling portion, and the casing defines a receiving space which is configured to receive at least one object and has at least one opening disposed therethrough. Part of an outer surface of the handling portion is flush with or protrusive beyond the at least one opening, and a material of the handling portion is different from a material of the casing.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
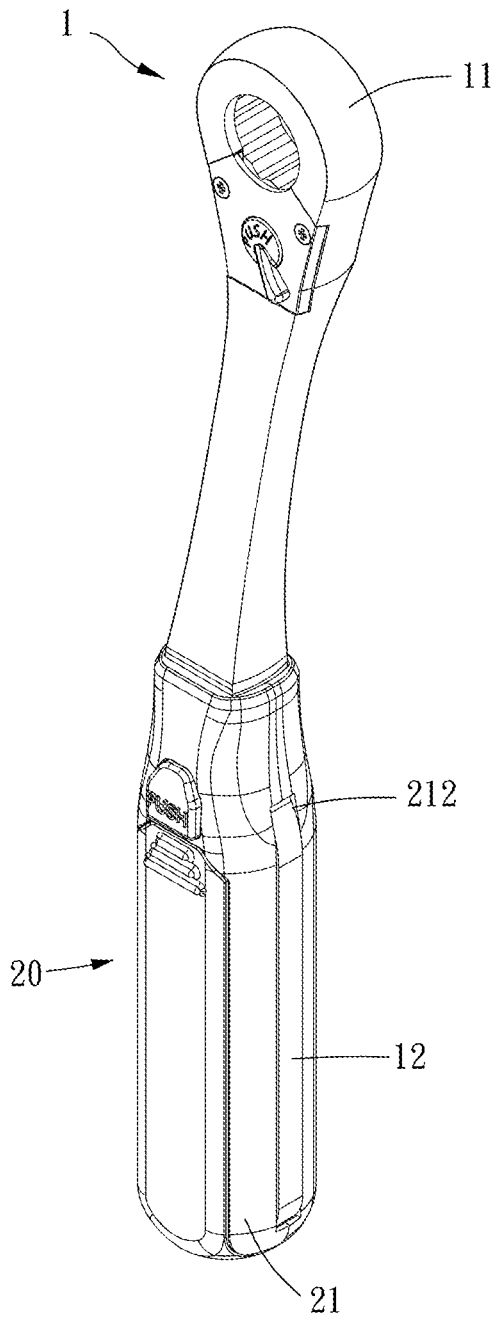
FIG. 1 is a stereogram of a preferable embodiment of the present invention.
Figure 2:
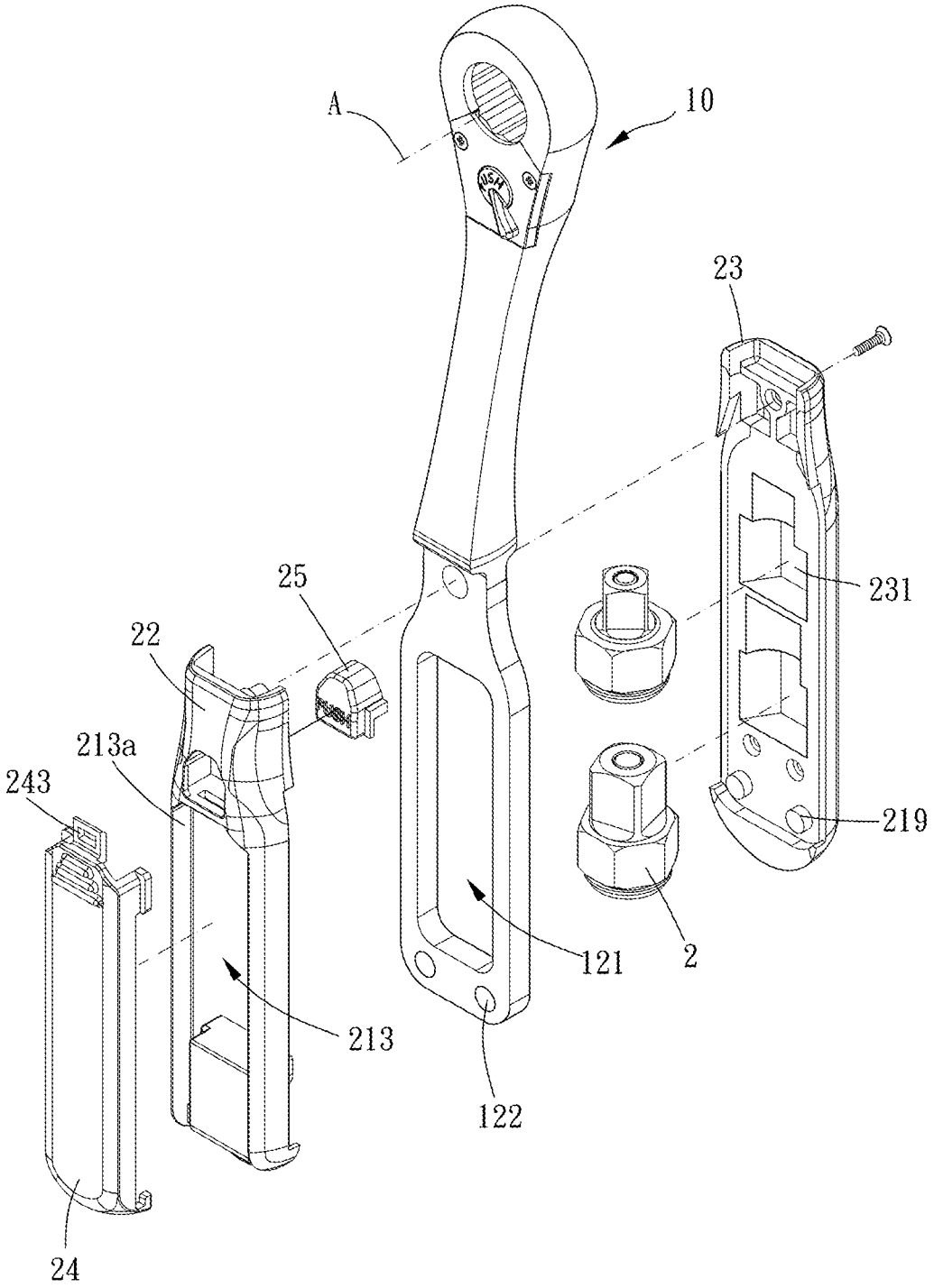
FIGS. 2 and 3 are breakdown drawings of a preferable embodiment of the present invention.
Figure 3:
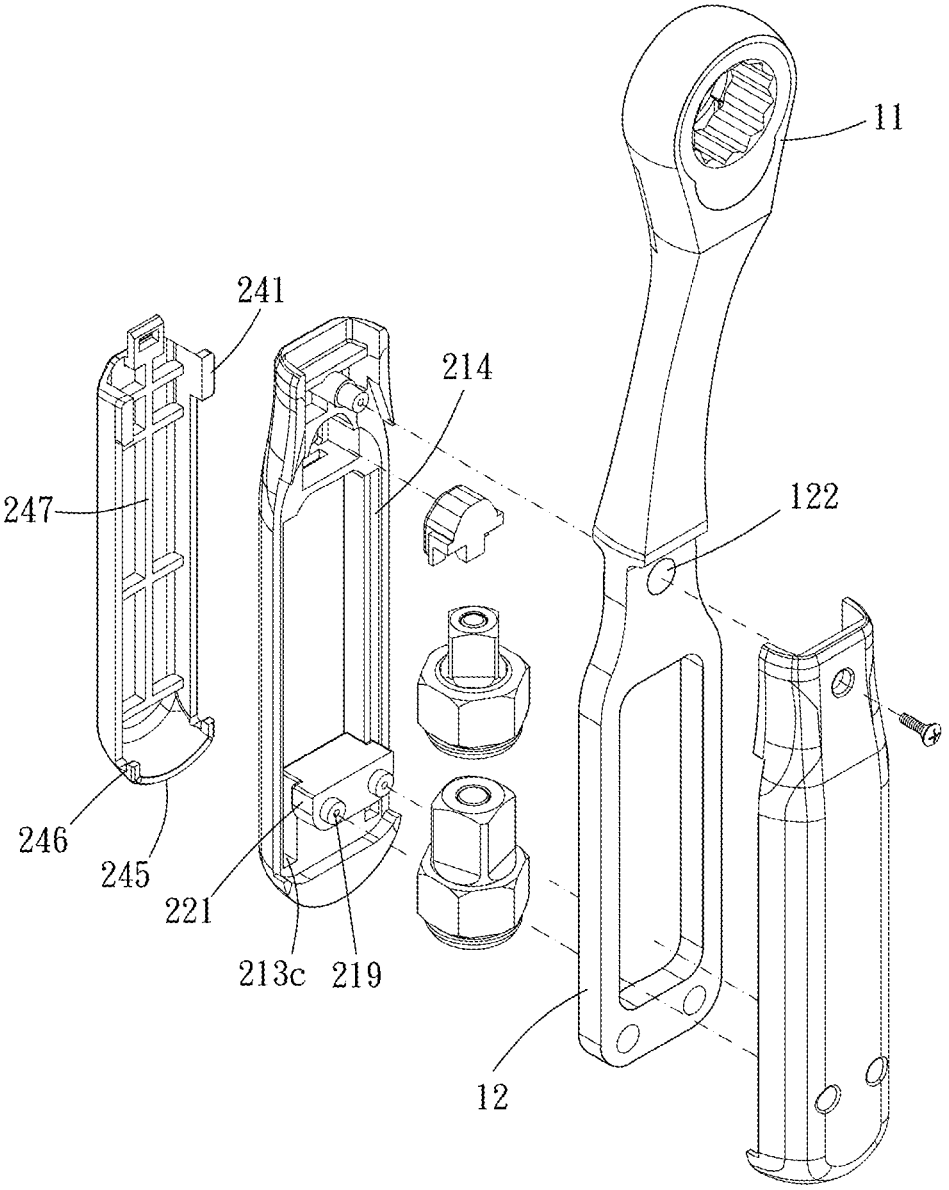
Figure 4:
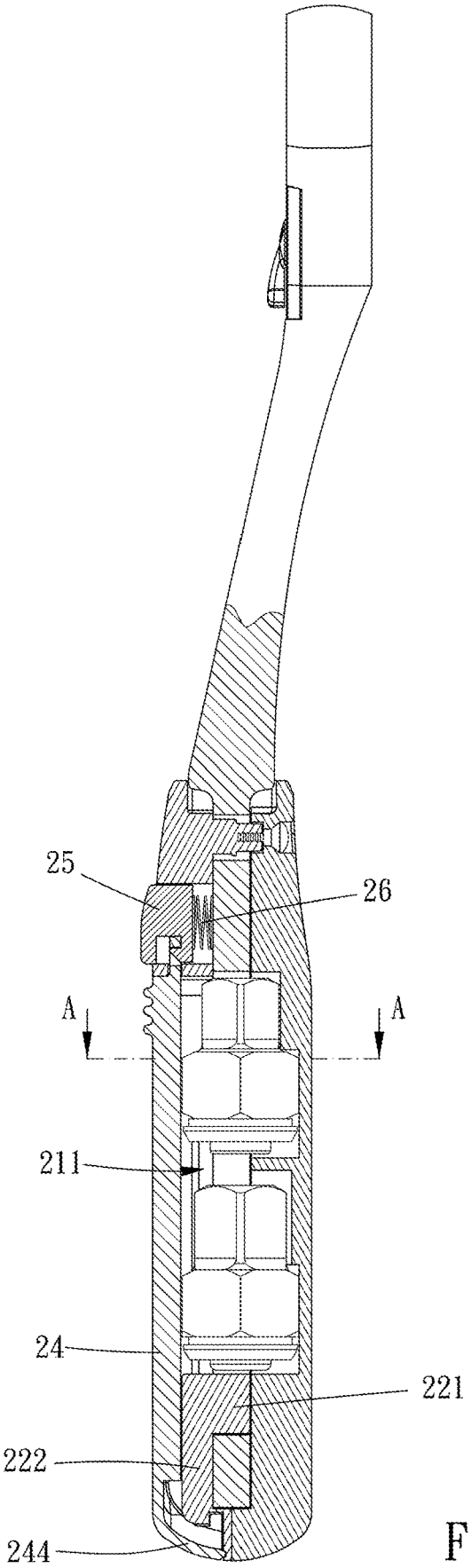
FIG. 4 is a cross-sectional view of a preferable embodiment of the present invention.
Figure 5:
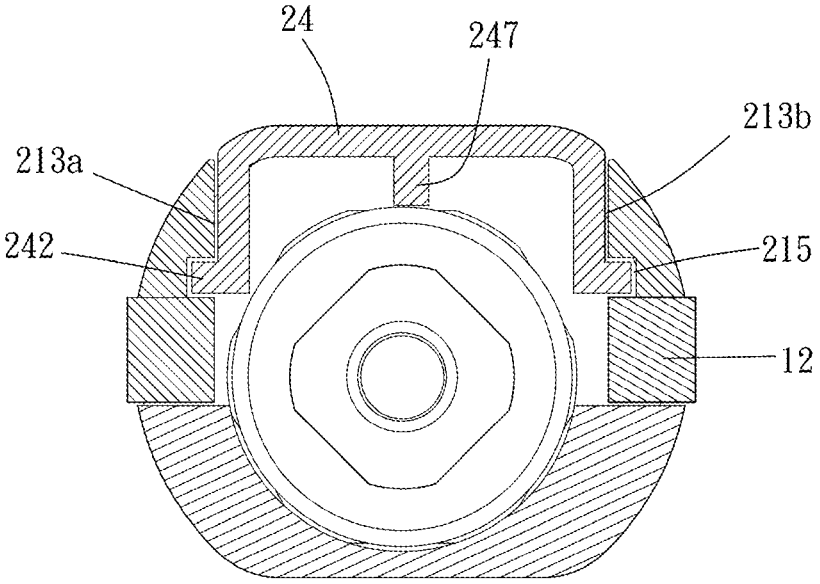
FIG. 5 is a cross-sectional view taken along line A-A of FIG. 4.

Please refer to FIGS. 1 to 9 for a preferable embodiment of the present invention. A ratchet wrench 1 of the present invention includes a main body 10 and a handling assembly 20.

The main body 10 includes a head portion 11 being assembled with a ratchet head 2 and a handling portion 12 remote from the head portion 11. The handling assembly 20 includes a casing 21 coveringly disposed on the handling portion 12, and the casing 21 defines a receiving space 211 which is configured to receive at least one object (such as ratchet heads 2, tool bits or fasteners) and has at least one opening 212. Part of an outer surface of the handling portion 12 is flush with or protrusive beyond the at least one opening 212, and a material of the handling portion 12 is different from a material of the casing 21. Therefore, the ratchet wrench 1 is configured to receive the at least one object and the handling portion 12 is partially exposed out of the at least one opening 212 for force exerted directly thereon, which provides good force transmission and preferable appearance.

In this embodiment, the casing 21 includes a first portion 22 and a second portion 23 which are connected opposite to each other, and the first portion 22 and the second portion 23 define the at least one opening 212. The handling portion 12 is detachably disposed between the first portion 22 and the second portion 23, which is convenient to maintain, replace and assemble; the main body 10 is made of metal so as to have sufficient structural strength, and the casing 21 is made of plastic and part of the handling portion 12 protrudes beyond the at least one opening 212 so that force can be directly exerted on the handling portion 12 and effectively transmitted to the ratchet head 2. Preferably, the casing 21 includes two said openings 212 disposed at two opposite sides of the casing 21, and each of the two said openings 212 is open in a direction transverse to a rotating axis A of the head portion 11 so that part of the handling portion 12 protruding beyond the two said openings 212 is directly held in an operational direction of the ratchet wrench 1 so as to have good force transmission effect. However, the casing may include more than two portions assembled together; the main body and the casing may be made of other materials; the casing may include the openings open toward other directions.

The casing 21 further has a through hole 213 being communicated with the receiving space 211, the handling assembly 20 further includes a cover 24 slidably and openably covering the through hole 213, which is convenient to take and place the at least one object. In this embodiment, the first portion 22 has the through hole 213, the cover 24 is disposed on the first portion 22 and slidable along a longitudinal direction of the handling portion 12, and the second portion 23 has at least one receiving groove 231 which is integrally formed thereon and configured to receive the at least one object, which has a simple structure and is convenient to manufacture and assemble. In other embodiments, the cover may be opened in a direction transverse to the longitudinal direction or be rotatable to be opened.

Specifically, the casing 21 further includes a first connecting portion 214, and the cover 24 includes a second connecting portion 241 which is slidably and engageably connected with the first connecting portion 214; one of the first connecting portion 214 and the second connecting portion 241 includes at least one engaging convex extending along the longitudinal direction of the handling portion 12, and the other of the first connecting portion 214 and the second connecting portion 241 includes at least one engaging concave which is slidably engaged with the at least one engaging convex so that the cover 24 is slidable relative to the casing 21. In this embodiment, the first connecting portion 214 includes two notches 215 which are disposed on two opposite sides of the through hole 213 and extend along the longitudinal direction of the handling portion 12, and the second connecting portion 241 includes two engaging legs 242 which are respectively engaged between one of the two notches 215 and a surface of the handling portion 12 facing the cover 24 so as to be stably and smoothly slidable and easy to assemble. In other embodiments, one of the first connecting portion and the second connecting portion may include at least one guiding groove, and the other of the first connecting portion and the second connecting portion may include at least one guiding projection which is engaged within the at least one guiding groove.

Figure 6:
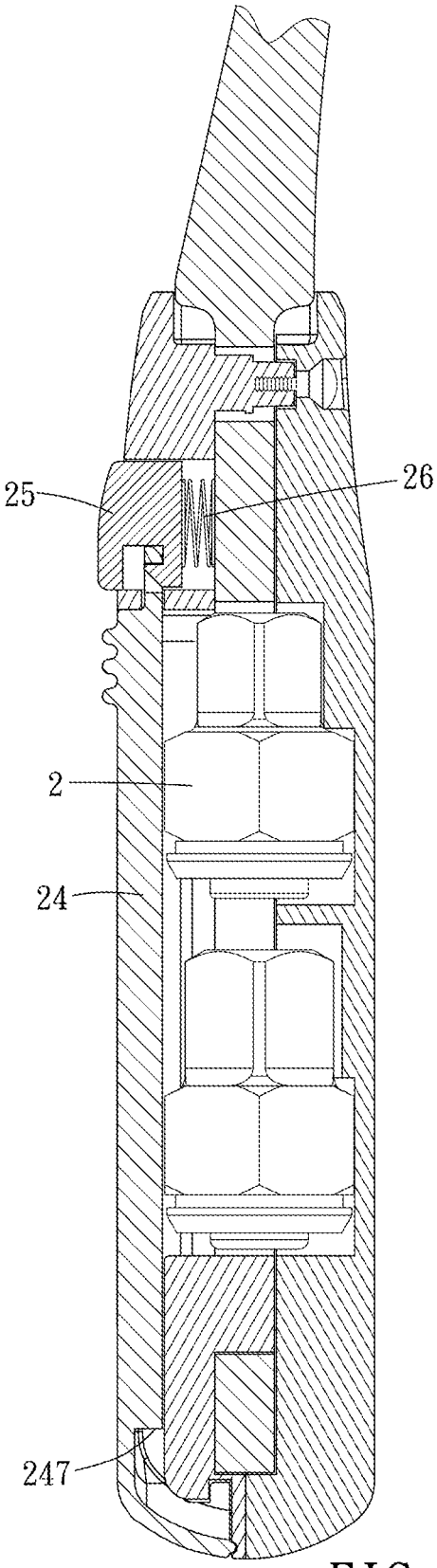
FIGS. 6 to 8 are schematic diagrams of a preferable embodiment of the present invention in operation.
Figure 7:
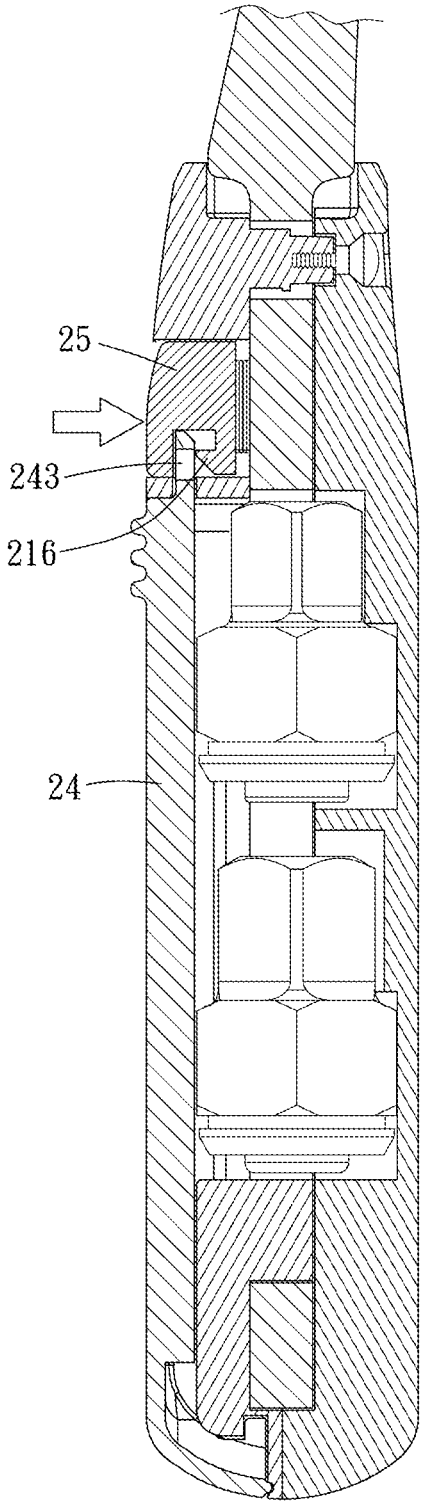
Figure 8:
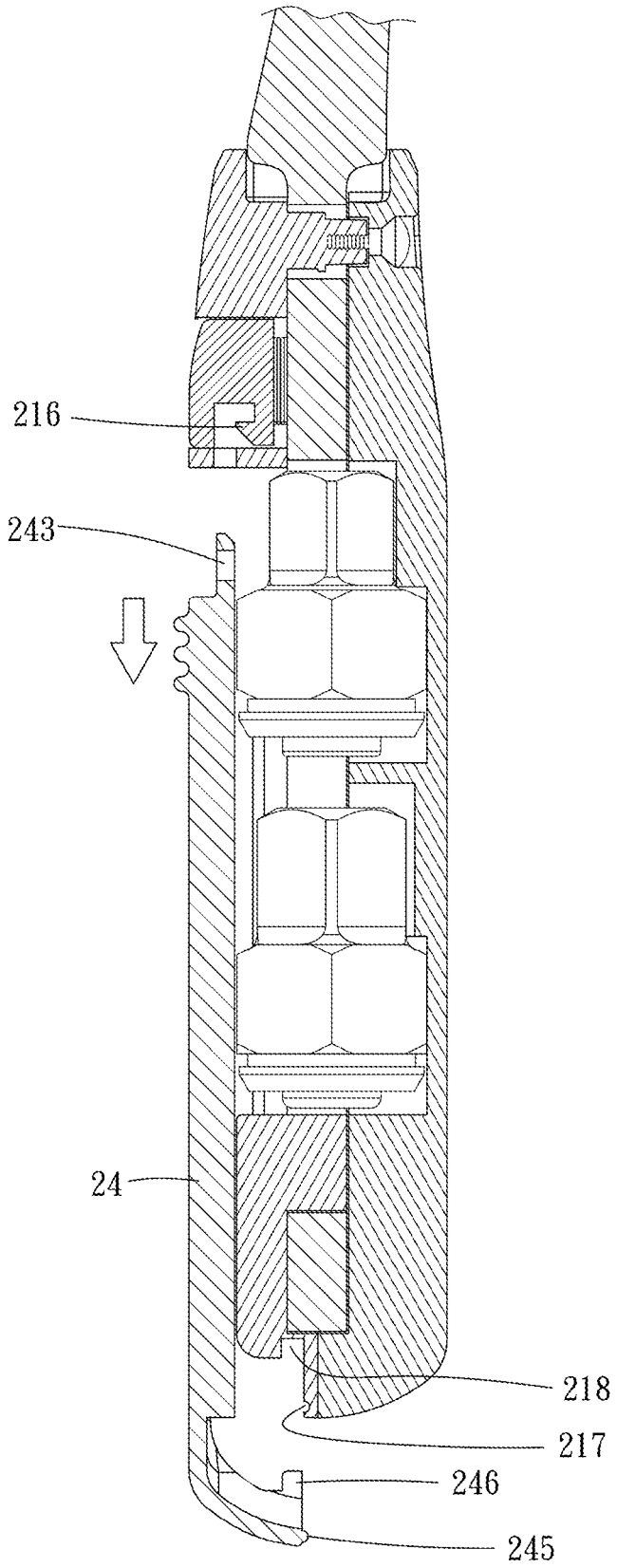
Figure 9:
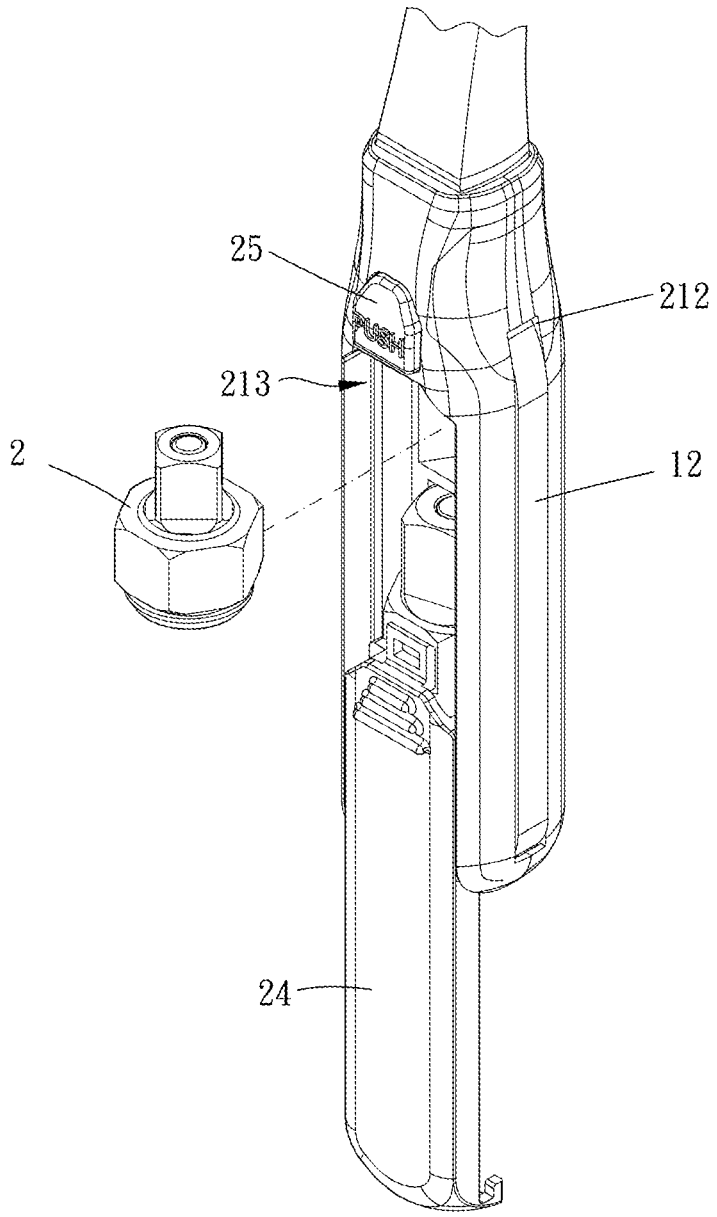
FIG. 9 is a schematic diagram of a preferable embodiment of the present invention in use.

The casing 21 further includes a first engaging portion 216, the cover 24 includes a second engaging portion 243 which is releasably engaged with the first engaging portion 216, and when the cover 24 covers the through hole 213, the first engaging portion 216 and the second engaging portion 243 are engaged with each other in a sliding direction of the cover 24 so as to prevent the cover 24 from being unexpectedly opened during operation. One of the first engaging portion 216 and the second engaging portion 243 is an engaging projection, and the other of the first engaging portion 216 and the second engaging portion 243 is an engaging recession for stable engagement. The casing 21 further includes an operating member 25 which is configured to be operable externally, and the operating member 25 has the first engaging portion 216 so that the first and second engaging portions 216, 243 are disengaged from each other by operating (such as pressing or pushing) the operating member 25, as shown in FIGS. 6 to 8. In this embodiment, the first engaging portion 216 is a hook, and the second engaging portion 243 is a hole in which the hook is engaged, the operating member 25 is elastically pushed by an elastic member 26 and has a tendency to move toward the second engaging portion 243, which has a simple structure and stable engagement.

Preferably, an end of the cover 24 remote from the head portion 11 includes a blocking portion 244 extending toward the casing 21, and the blocking portion 244 is abuttable against the casing 21 in the sliding direction of the cover 24 so as to avoid excessive sliding and damage to components. An end surface of the blocking portion 244 has an arcuate convex 245, the casing 21 further has an arcuate concave 217 within which the arcuate convex 245 is at least partially receivable, and the arcuate convex 245 and the arcuate concave 217 interfere with each other in the sliding direction. Therefore, the arcuate convex 245 is embeddably restrictable to the arcuate concave 217 and smoothly moved into or out of the arcuate concave 217. However, the arcuate convex may be disposed on the casing, and the arcuate concave may be disposed on the end surface of the blocking portion. The blocking portion 244 further has at least one projection 246 protruding laterally toward the casing 21, and the casing 21 further has at least one recession 218 within which the at least one projection 246 is at least partially receivable, and the at least one projection 246 and the at least one recession 218 are blockable with each other in a direction transverse to the sliding direction so as to prevent the cover 24 from disengaging from the casing 21 for stable assembling.

The handling portion 12 has at least one receiving hole 121 being communicated with the receiving space 211, and an end of the first portion 22 remote from the head portion 11 includes a protruding portion 221 extending toward the second portion 23. The protruding portion 221 protrudes into the receiving hole 121 and is abutted against an inner periphery surface of the receiving hole 121, and the protruding portion 221 is detachably assembled with the second portion 23 so that the handling portion 12 and the casing 21 are restrictedly connected with each other and easy to assemble/disassemble. Specifically, the casing 21 further includes inner sidewalls defining the through hole 213, and one of the inner sidewalls 213*c* remote form the first engaging portion 216 has a connecting portion 222 extending inwardly. The protruding portion 221 is integrally disposed protrudingly on the connecting portion 222, and the connecting portion 222 are spaced apart from another two of the inner sidewalls 213*a*, 213*b* which are located at two opposite sides of the connecting portion 222 and have the two notches 215, and each of the two engaging legs 242 is movable between the connecting portion 222 and one of the two of the inner sidewalls 213*a*, 213*b*. Therefore, the cover 24 can slide relative to the first portion 22 until the through hole 213 is completely open outwardly, which is convenient to take and place the at least one object. However, the cover may be configured to partially cover the through hole.

An inner surface of the cover 24 facing the casing 21 has a plurality of ribs 247 so as to increase structural strength. An extent of one of the plurality of ribs 247 is preferably larger than an extent of the through hole 213 so that one of the plurality of ribs 247 is configured to be abutted against the at least one object received in the receiving space 211, which avoids dislocation of the at least one object during operating the ratchet wrench 1. The handling portion 12 further has a plurality of positioning holes 122, and the casing 21 further has a plurality of positioning columns 219 which are at least partially received within the plurality of positioning holes 122. In this embodiment, the plurality of positioning holes 122 are disposed on two opposite sides of the receiving hole 121 in the longitudinal direction, and the first portion 22 and the second portion 23 each have at least one of the plurality of positioning columns 219 for stable assembling.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A ratchet wrench, including:

a main body, including a head portion being assembled with a ratchet head and a handling portion remote from the head portion;

a handling assembly, including a casing coveringly disposed on the handling portion, the casing defining a receiving space which is configured to receive at least one object and having at least one opening disposed therethrough, part of an outer surface of the handling portion being flush with or protrusive beyond the at least one opening, and a material of the handling portion being different from a material of the casing;

wherein the casing further has a through hole being communicated with the receiving space, and the handling assembly further includes a cover slidably and openably covering the through hole.

2. The ratchet wrench of claim 1, wherein the casing further includes a first connecting portion, and the cover includes a second connecting portion which is slidably and engageably connected with the first connecting portion.

3. The ratchet wrench of claim 2, wherein one of the first connecting portion and the second connecting portion includes at least one engaging convex extending along a longitudinal direction of the handling portion, and the other of the first connecting portion and the second connecting portion includes at least one engaging concave which is slidably engaged with the at least one engaging convex.

4. The ratchet wrench of claim 3, wherein the first connecting portion includes two notches which are disposed on two opposite sides of the through hole and extend along a longitudinal direction of the handling portion, the second connecting portion includes two engaging legs which are respectively engaged between one of the two notches and a surface of the handling portion facing the cover; the casing includes a first portion and a second portion which are connected opposite to each other, and the first portion and the second portion define the at least one opening; the first portion has the through hole, the cover is disposed on the first portion and slidable along the longitudinal direction, the second portion has at least one receiving groove which is integrally formed thereon and configured to receive the at least one object; the casing further includes a first engaging portion, the cover includes a second engaging portion which is releasably engaged with the first engaging portion, when the cover covers the through hole, the first engaging portion and the second engaging portion are engaged with each other in a sliding direction of the cover; the casing further includes an operating member which is configured to be operable externally, the operating member has the first engaging portion; one of the first engaging portion and the second engaging portion is an engaging projection, and the other of the first engaging portion and the second engaging portion is an engaging recession; an end of the cover remote from the head portion includes a blocking portion extending toward the casing, the blocking portion is abuttable against the casing in the sliding direction of the cover; an end surface of the blocking portion has an arcuate convex, the casing further has an arcuate concave within which the arcuate convex is at least partially receivable, the arcuate convex and the arcuate concave interfere with each other in the sliding direction; the blocking portion further has at least one projection protruding laterally toward the casing, the casing further has at least one recession within which the at least one projection is at least partially receivable, the at least one projection and the at least one recession are blockable with each other in a direction transverse to the sliding direction; the handling portion has at least one receiving hole being communicated with the receiving space, an end of the first portion remote from the head portion includes a protruding portion extending toward the second portion, the protruding portion protrudes into the receiving hole and is abutted against an inner periphery surface of the receiving hole, and the protruding portion is detachably assembled with the second portion; the casing further includes inner sidewalls defining the through hole, one of the inner sidewalls remote from the first engaging portion has a connecting portion extending inwardly, the protruding portion is integrally disposed protrudingly on the connecting portion, the connecting portion are spaced apart from another two of the inner sidewalls which are located at two opposite sides of the connecting portion and have the two notches, each of the two engaging legs is movable between the connecting portion and one of the two of the inner sidewalls; an inner surface of the cover facing the casing has a plurality of ribs, an extent of one of the plurality of ribs is larger than an extent of the through hole; the handling portion further has a plurality of positioning holes, the casing further has a plurality of positioning columns which are at least partially received within the plurality of positioning holes; the casing includes two said openings disposed at two opposite sides of the casing, each of the two said openings is open in a direction transverse to a rotating axis of the head portion, and the handling portion partially protrudes beyond the two said openings.

5. The ratchet wrench of claim 2, wherein the first connecting portion includes two notches which are disposed on two opposite sides of the through hole and extend along a longitudinal direction of the handling portion, and the second connecting portion includes two engaging legs which are respectively engaged between one of the two notches and a surface of the handling portion facing the cover.

6. The ratchet wrench of claim 1, wherein the casing further includes a first engaging portion, the cover includes a second engaging portion which is releasably engaged with the first engaging portion, and when the cover covers the through hole, the first engaging portion and the second engaging portion are engaged with each other in a sliding direction of the cover.

7. The ratchet wrench of claim 1, wherein an end of the cover remote from the head portion includes a blocking portion extending toward the casing, and the blocking portion is abuttable against the casing in a sliding direction of the cover.

8. The ratchet wrench of claim 1, wherein the casing includes a first portion and a second portion which are connected opposite to each other, and the first portion and the second portion define the at least one opening.

9. The ratchet wrench of claim 8, wherein the handling portion has at least one receiving hole being communicated with the receiving space, an end of the first portion remote from the head portion includes a protruding portion extending toward the second portion, the protruding portion protrudes into the receiving hole and is abutted against an inner periphery surface of the receiving hole, and the protruding portion is detachably assembled with the second portion.

* * * * *